US012137786B1

(12) United States Patent
Ragosta

(10) Patent No.: US 12,137,786 B1
(45) Date of Patent: Nov. 12, 2024

(54) ROTATING HAIR STYLING AND DRYING DEVICE

(71) Applicant: M. M. & R. Products, Inc., Ventura, CA (US)

(72) Inventor: Michael A. Ragosta, Ventura, CA (US)

(73) Assignee: M. M. & R. Products, Inc., Ventura, CA (US)

( * ) Notice: Subject to any disclaimer, the term of this patent is extended or adjusted under 35 U.S.C. 154(b) by 0 days.

(21) Appl. No.: 18/434,164

(22) Filed: Feb. 6, 2024

(51) Int. Cl.
*A45D 20/12* (2006.01)
*A45D 20/50* (2006.01)
*A45D 20/52* (2006.01)

(52) U.S. Cl.
CPC ..... *A45D 20/12* (2013.01); *A45D 20/50* (2013.01); *A45D 20/52* (2013.01)

(58) Field of Classification Search
CPC ..... A45D 20/12; A45D 20/50; A45D 20/52
USPC ..... 34/96, 238
See application file for complete search history.

(56) References Cited

U.S. PATENT DOCUMENTS

| | | | | |
|---|---|---|---|---|
| 6,098,635 | A | 8/2000 | Marino | |
| 7,481,228 | B2 | 1/2009 | Ragosta et al. | |
| 7,631,646 | B2 | 12/2009 | Ragosta et al. | |
| 8,342,191 | B2 | 1/2013 | Ragosta et al. | |
| 8,360,076 | B2 | 1/2013 | Ragosta et al. | |
| D678,609 | S | 3/2013 | Ragosta et al. | |
| 8,539,965 | B2 | 9/2013 | Ragosta et al. | |
| 8,567,416 | B2 | 10/2013 | Ragosta et al. | |
| 8,881,423 | B2 | 11/2014 | Ragosta et al. | |
| D726,369 | S | 4/2015 | Richmond et al. | |
| 9,107,485 | B2 * | 8/2015 | Ragosta | A45D 1/04 |
| 9,259,069 | B2 | 2/2016 | Ragosta et al. | |
| 9,521,891 | B2 | 12/2016 | Ragosta et al. | |
| 9,609,941 | B2 | 4/2017 | Ragosta et al. | |
| D900,391 | S * | 10/2020 | Ragosta | D28/18 |
| D959,053 | S * | 7/2022 | Ragosta | D28/18 |
| 2003/0052115 | A1 * | 3/2003 | Leung | A45D 20/50 132/118 |
| 2014/0053426 | A1 * | 2/2014 | Ragosta | A45D 20/12 34/283 |
| 2016/0100681 | A1 * | 4/2016 | Smal | A45D 6/04 132/238 |
| 2021/0007472 | A1 * | 1/2021 | Chu | A45D 20/52 |

FOREIGN PATENT DOCUMENTS

| | | | | |
|---|---|---|---|---|
| FR | 3049830 | A1 * | 10/2017 | A45D 20/10 |

* cited by examiner

*Primary Examiner* — John P McCormack
(74) *Attorney, Agent, or Firm* — Laura M. King; Matrix Law Group, LLP

(57) ABSTRACT

A hair styling device having a rotatable body portion, the body portion comprising a longitudinal axis about which the body rotates. The device has a plurality of projections extending outwardly from the body portion and two or more divider elements extending from the body portion. The device also has a handle attached to the body portion and a blower supported by the handle. The device has a first gas flow conduit in gas flow communication with the blower, the first conduit having a proximal portion supported by the body portion and a distal portion away from the body portion and a first nozzle in gas flow communication with the first conduit and oriented to blow air from the distal portion of the first conduit toward the body portion. Methods for using the hair styling device are described.

17 Claims, 8 Drawing Sheets

ROTATING HAIR STYLING AND DRYING DEVICE

BACKGROUND

There are numerous devices on the market that can dry, style, or simultaneously dry and style hair. The most common type of hair drying device, typically referred to as a blow dryer, delivers a stream of hot air for drying and styling hair. A diffuser can be attached to the blow dryer air outlet to disperse the air flow from the hair dryer to allow the hair to retain its natural curls, body, and texture without frizz. Similarly, a concentrator can be attached to the blow dryer air outlet to focus and intensify hot air flow in order to speed drying. To add body or to style hair in particular shapes, many people simultaneously blow dry and brush their hair—the starting hair can be wet, damp, or dry. Desirable results are achieved by pulling the bristles of a hairbrush through the hair from the roots to the ends while heat, such as in the form of hot air from a hair dryer, is applied directly to the hair. The process of brushing hair separates hair strands, smooths hair cuticles and pulls oil from the scalp region and spreads it throughout the hair, which adds body and shine to the hair and keeps the hair healthy.

Typically, hair dryers have a tubular body that houses a blower with an air intake and air outlet. An electric motor is provided to run an internal fan which draws air from the environment into the air intake. The air is generally forced across a heating element toward the air outlet. The heated air flows through the air outlet and out of the body surrounding the air outlet. The circular cross section dries and smooths the top surface of the hair, while the hair underneath remains wet for a longer period of time.

A conventional hair dryer has a circular cross section flow pattern. Accessories can be attached to the body surrounding the air outlet of the hair dryer. The heated air flows through the body and exits the air outlet and through the accessory, altering the flow pattern of the air. A variety of accessories are known for altering the flow pattern of air from the hair dryer, such as those described in U.S. Pat. Nos., D426674, 4538362, D440354, and French Patent No. 2888095. However, each of these devices suffers from one or more of the disadvantages of low efficiency, as well as the inability to create volume and a smooth, finished hair style.

One method of simultaneous drying and styling wet hair or styling dry hair involves rotating a brush, typically a round brush, so that the bristles move through the hair. A user can usually rotate a brush about one half turn manually and, during or after each half turn, the user pulls the brush from the hair. The brush is then replaced in the same section of hair or a new location, usually adjacent to the preceding location, and the process is repeated. The method of rotating the brush, particularly a round brush, can be enhanced by motorizing rotation. Exemplary embodiments of such a brush are described in U.S. Pat. No. 6,098,635 to Marino, the entire content of which is incorporated herein by reference. When proper tension is placed on the hair with a brush, the hair is elongated, and when heat is applied during a blowout, even frizzy and otherwise unmanageable hair can achieve a sleek, glossy appearance which can last for several days.

Many consumers pay a premium to have their hair professionally blown dry to achieve a finished salon look or style. Hair stylists operate by meticulously drying and styling specific sections of the hair. When drying hair, the hair stylist uses a brush, selects a small section of hair, and repeatedly applies heat to the hair with a hair dryer while brushing. By focusing the heat on a particular section and simultaneously pulling the brush in a desired direction, the drying process shapes the hair, creating volume and style. For example, when the heated air from the dryer is applied to hair on a brush, and the brush is pulled downward from the roots toward the ends of the hair, a smooth finish is created.

There are hair dryer brushes on the market that can simultaneously dry and style the hair. In use, hot air is blown from the center of hair dryer into the brush head and out of the brush head to the underside of the user's hair. All these devices blow air out of some array of openings and through the hair, thus having a tendency to blow hair up and away from the brush bristles. Additionally, a significant amount of the hot air is not utilized, which increases drying time and reduces efficiency. In some hair dryer brush models, the brush rotates around the handle. However, these devices can be difficult to use, and often result in tangling of hair during use for an inexperienced user, especially for longer hair, hair that is improperly sectioned, or improper brush positioning by the user. Hair dryer brushes with air flow features that concentrate and focus air flow directly onto the hair and bristles, as the combination of a blow dryer and hairbrush does, can overcome the inefficiency and waste of current hair dryer brushes. Exemplary embodiments of such a brush are described in U.S. Pat. No. 8,881,423 to Ragosta et. al., the entire content of which is incorporated herein by reference.

Styling the hair using a brush and separate hair dryer is disadvantageous for a user due to the complexity of manipulating the separate devices. For example, most hair dryer modifications have awkward configurations, making the drying process even more challenging for the user, which can be tiresome and frustrating. Furthermore, accomplishing rotation evenly over all regions of the scalp is difficult because it is unnatural for a user to rotate his or her hand to the necessary positions. Specifically, blow drying one's own hair requires reaching around the head with the arms raised and providing the proper twist or rotation to the brush, which is very difficult in that position. Coordinating brush movement while aiming the dryer onto the hair on the brush adds to the difficulty. Hair stylists can accomplish these positions more easily because they can move relative to a person's head.

In addition to brushing hair, it is often desirable to style one's hair in a particular manner, such as curling straight hair or straightening curly hair. Usually, a separate apparatus such as a curling iron or flat iron is necessary to curl, straighten, or otherwise style the hair.

For the foregoing reasons, there is a need for a hair treatment device that overcomes the disadvantages of prior devices.

SUMMARY

A hair styling device having features of the present invention satisfies the above-identified needs. An exemplary hair styling device has a handle and a blower supported by the handle. It also has a body having a longitudinal axis attached to the handle, with a plurality of projections extending outwardly from the body and two or more divider elements extending from the body. There is a first gas flow conduit in gas flow communication with the blower, the first gas flow conduit having a longitudinal axis and a proximal portion supported by the body and a distal portion away from the body and a first nozzle in gas flow communication with the distal potion of the first gas flow conduit and oriented to blow air from the distal portion of the first gas flow conduit toward the body at an angle greater than one hundred degrees relative to the longitudinal axis. There is also a second gas flow conduit in gas flow communication with the blower, the second gas flow conduit having a longitudinal axis and a proximal portion supported by the brush portion and a distal portion away from the body and a second nozzle in gas flow communication with the distal potion of the second gas flow conduit and oriented to blow air from the distal portion of the second gas flow conduit toward the body at an angle greater than one hundred degrees relative to the longitudinal axis. The device also can have a motor for rotating the body about its longitudinal axis relative to the handle.

It is contemplated that the motor can rotate the body portion in both clockwise and counterclockwise directions. It is also contemplated that the projections can be bristles. In one aspect, at least a portion of the plurality of projections can be positioned in a row extending parallel to a longitudinal length of the body and between the two or more divider elements.

The hair styling device can further have a heating means such as a heating element or a heated blower. Additionally, the gas flow conduit can have a longitudinal axis and the nozzle can direct the air from the distal portion of the gas flow conduit toward the body at an angle greater than one hundred degrees relative to the longitudinal axis.

In another embodiment, a hair styling device having a rotatable body portion with a longitudinal axis about which the body rotates is described. The body portion has a plurality of projections extending outwardly from the body portion, two or more divider elements extending from the body portion, and a handle attached to the body portion. There is a blower supported by the handle, a first gas flow conduit in gas flow communication with the blower, the first conduit having a proximal portion supported by the body portion and a distal portion away from the body portion; and a first nozzle in gas flow communication with the first conduit and oriented to blow air from the distal portion of the first conduit toward the body portion.

In another embodiment, a method of styling a section of hair is described. The method includes the steps of grasping the hair styling device as described above and placing the section of hair adjacent to and engaged with the plurality of projections in a location where the air is blown from the first and second nozzles. The rotatable body portion and blower are activated either before or after the hair is placed on the plurality of projections. The hair styling device is then pulled through the hair while the air is blown from the first and second nozzles and the body rotates about the longitudinal axis.

DRAWINGS

These and other features, aspects, and advantages of the present invention will become better understood with reference to the following description, appended claims, and accompanying drawings where:

DESCRIPTION

Figure 1:
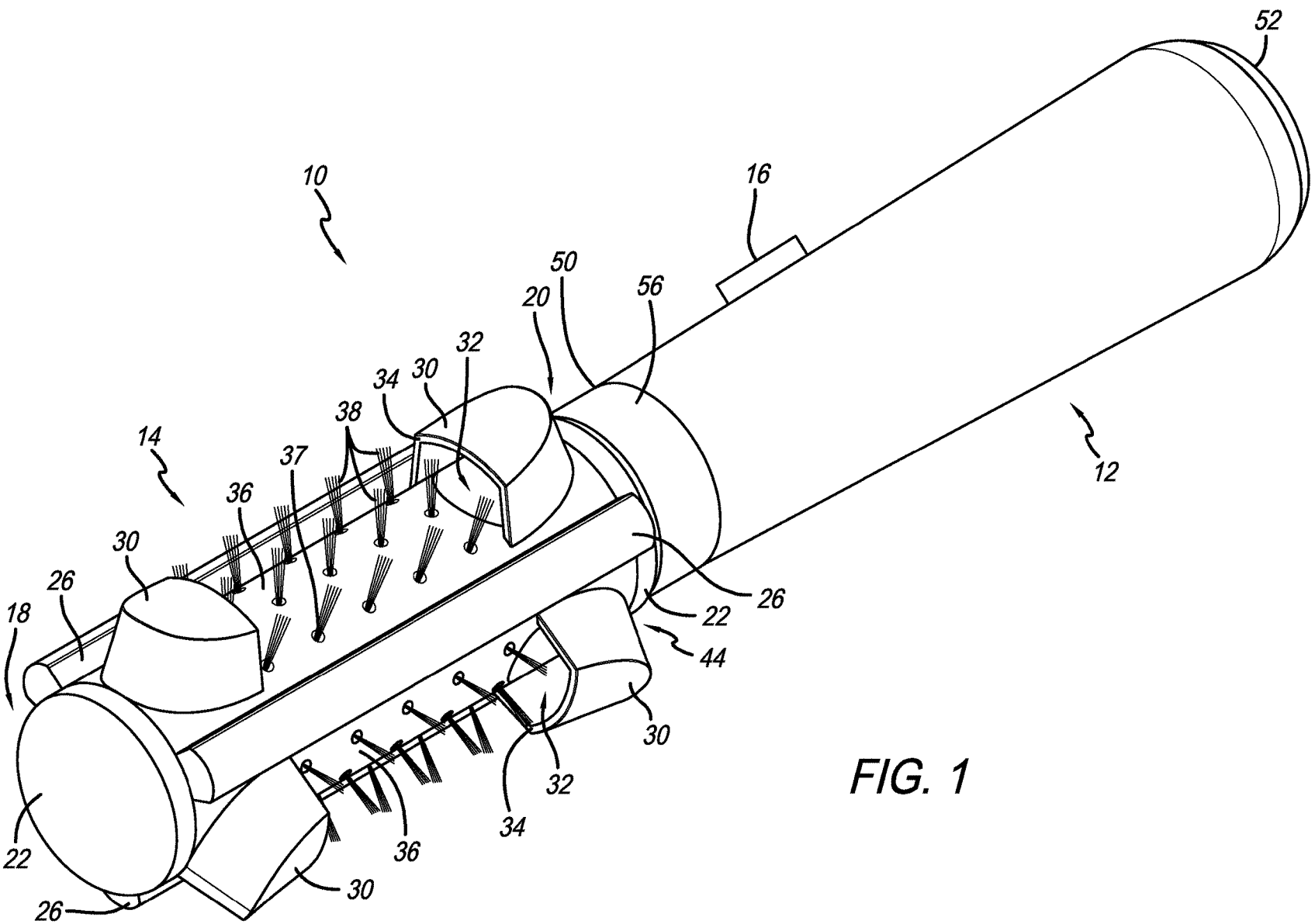
FIG. 1 is a perspective view of a hair styling device having features of the invention.
Figure 2:
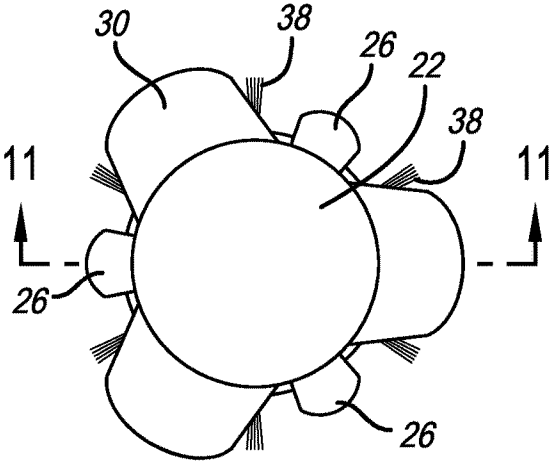
FIG. 2 is a top plan view of the hair styling device having features of the invention.
Figure 3:
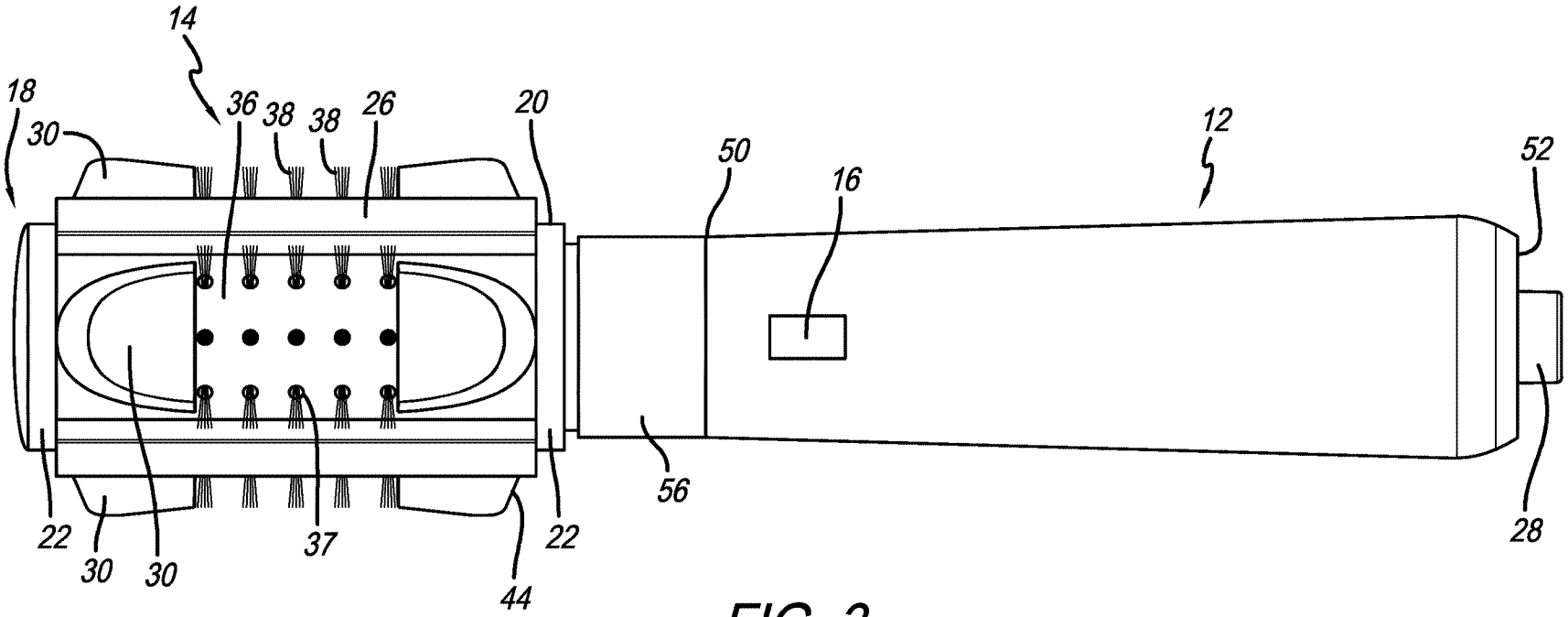
FIG. 3 is a side elevation view of the hair styling device having features of the invention.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used herein, the term "comprise" and variations of the term, such as "comprising" and "comprises," are not intended to exclude other additives, components, integers or steps.

As used herein, "distal" shall generally refer to a position or direction away from or farthest from a point or origin. Conversely, "proximal" generally refers to a position or direction towards or closest to a point or origin.

A "hair styling device" can be used to style hair, dry hair, or simultaneously dry and style hair.

The present invention is directed to a hair styling device capable of drying and styling hair, and a method for drying and styling hair using the device of the invention. In the following description, numerous specific details are set forth to provide a more thorough description of embodiments of the invention. It will be apparent, however, to one skilled in the art that the embodiments of the present invention can be practiced without these specific details. In other instances, well-known features have not been described in detail so as not to obscure the invention.

Referring to FIGS. 1-6, a hair styling device 10 having features of the present invention is shown. The hair styling device 10 comprises a body 14 having a longitudinal length and a longitudinal axis that extends from a body end cap 22 to a handle mount collar 56. The body 14 also has a proximal section 20 with a handle mount collar 56 which is attached to a handle 12, and a distal section 18 with the body end cap 22 positioned away from the handle 12. The specific dimensions of the handle 12 are not critical, but the handle 12 should generally allow a user to comfortably hold the hair styling device 10 during use. In one exemplary embodiment, the handle 12 may be adapted to house other mechanical and electrical components of the hair styling device 10, as described in more detail below.

The body 14 comprises projections 38 such as bristles, one or more divider elements 26, and one or more gas flow conduits 30. In one embodiment, the body 14 is attached to the handle 12 and is capable of rotating independently from the handle 12. The hair styling device 10 may be manually rotatable or may be powered by an electrical source as described further below.

Referring again to FIGS. 1, 3, 4 and 6, the handle 12 is generally of a cylindrical shape, but may comprise other shapes which suitably incorporate the features of the invention and may be comprised of a variety of materials including metal, plastic or wood. In a preferred version of the invention, the handle is from a diameter of from about 0.5 inches (1.3 cm) to about 3 inches (7.6 cm), depending on the application. The handle 12 may additionally have cushioning and/or slip resistant features which are built into the handle or attached thereto, such as foam cushioning and/or slip resistant grooves.

The handle 12 may house an internal battery such as, for example, a rechargeable battery (not shown), or optionally, the hair styling device 10 may be directly powered by electricity from an electrical outlet, in which case the hair styling device 10 would also include a cord 28 and plug for powering the device. One or more switches 16 can be located on the handle 12 or at another appropriate location to control the airflow, heat, and/or rotation of the hair styling device 10. It is contemplated that the one or more switches 16 may control the direction that the body 14 rotates, be used as on and off switch, and to control the speed of rotation of the body 14. The device may have a single or variable rotation speeds from about 30 rpm to about 140 rpm.

The hair styling device 10 may also include means for locking the handle mount collar 56 to the handle 12, such as a detent fitting into an indentation or a bayonet fitting. Preferably, the connection between the handle 12 and the handle mount collar 56 is rigid so the body 14 does not wobble as it rotates. In general, the body 14 is positioned such that it is aligned along the same horizontal axis as the handle 12. However, in some versions, the body 14 and handle 12 are fixed at a lesser angle, and in other versions, the body 14 may pivot with respect to the handle 12 such that the body 14 and handle 12 are positioned at an angle less than 180 degrees, such as an angle between about 175 degrees to about 90 degrees. Preferably, when the handle 12 pivots, the handle 12 will lock in place with respect to the body 14 in the different handle positions.

The hair styling device 10 has a rotation means for rotating the body 14 about its longitudinal axis relative to the handle mount collar 56. The handle mount collar 56 is permanently attached to the body 14 and can be permanently or removably affixed to a handle 12. The handle mount collar 56 can be removably affixed to the handle 12 by, for example, snapping, spring loading, or twisting it to hold it in place. The handle 12 may also contain a motor shaft 65 for rotating the body 14. In one exemplary embodiment, a motor shaft 65 has a drive gear feature located at the distal end of the handle 50 which meshes with a corresponding rotation gear inset feature 58 at the proximal end of rotation rod 59 which is located at the proximal end of the body 20 and aligns the body 14 to the handle 12. The connection is covered by the handle mount collar 56 to connect and seal the proximal end of the body 12 to the distal end of the handle 12 and prevent, for example, hot air provided through the internal cavity 24 from escaping from the distal end of the body 18.

Figure 7:
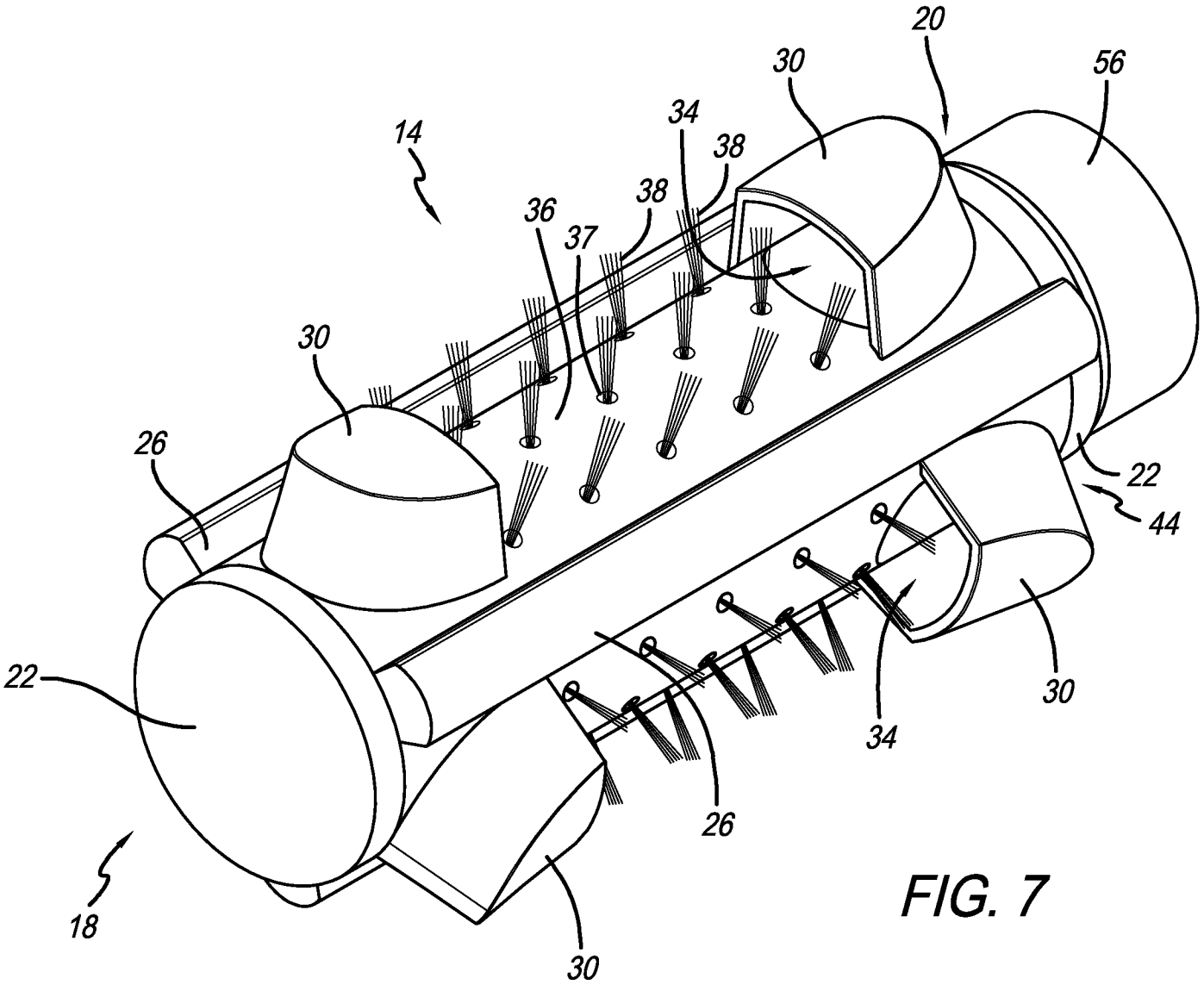
FIG. 7 is a perspective view of a hair styling device having features of the invention.
Figure 9:
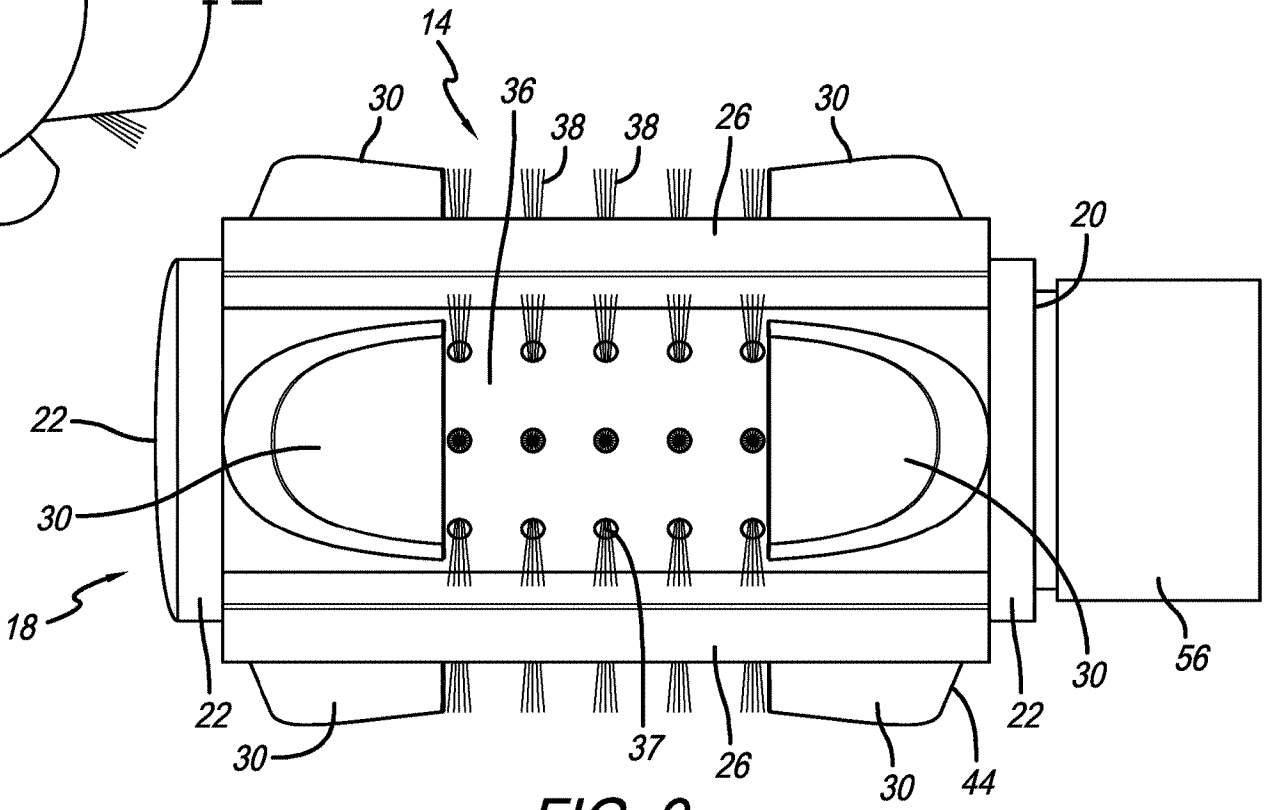
FIG. 9 is a side elevation view of the hair styling device having features of the invention.
Figure 8:
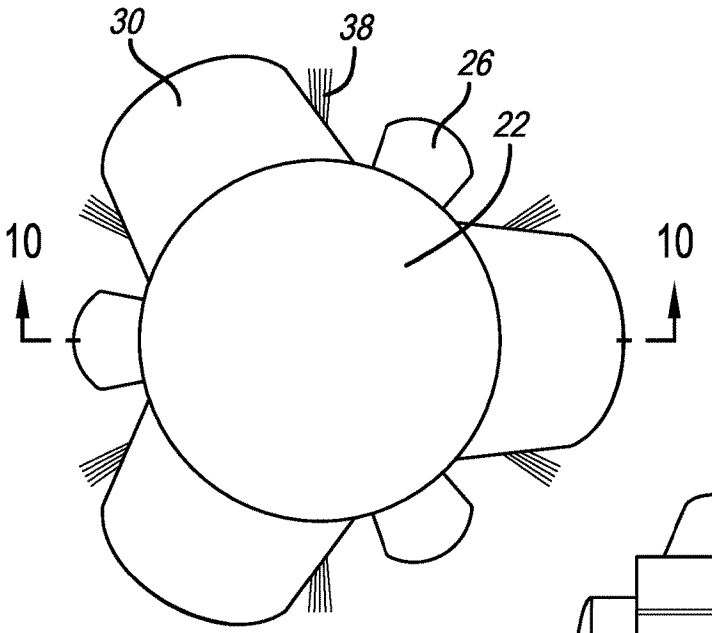
FIG. 8 is a is a top plan view of the hair styling device having features of the invention.

According to another version of the invention shown in FIGS. 7-9, the hair styling device 10 may have a body 14 that can be supplied separately or may be removable from the handle 12. According to this version, a body 14 with different projections 38, i.e., differing bristles or bristle arrangements may be used interchangeably with the handle 12. The body 14 can be a stand-alone unit and can be used on a different specially fitted handle 12 or removably attached to a hair dryer by means of the handle mount collar 56. Further, when the body 14 is removable, the user may remove a brush to change to another brush configuration, for cleaning, or if the projections 38 break, the user can exchange a damaged body 14 with a new body 14.

Figure 10:
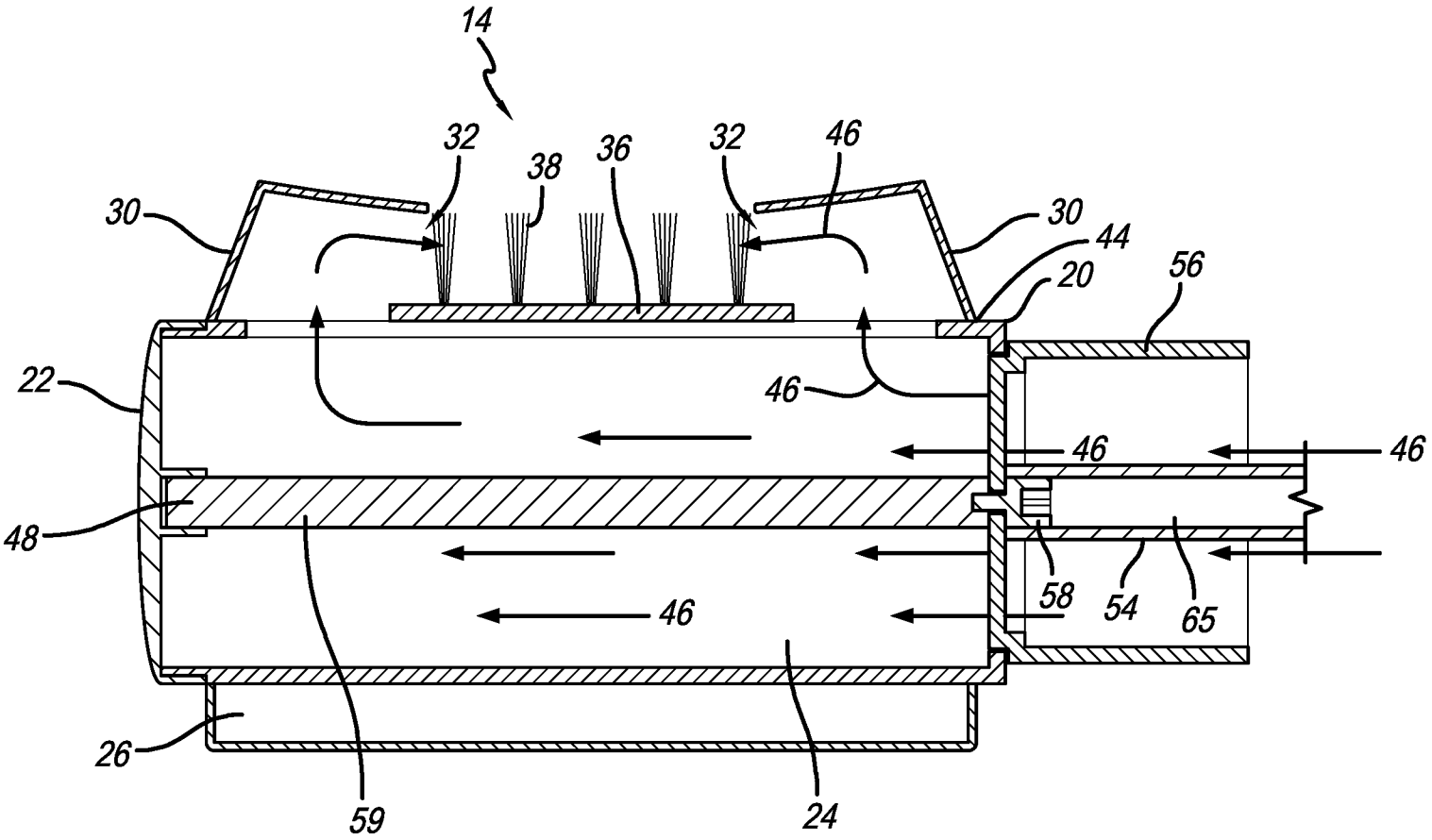
FIG. 10 is a sectional view of the device in FIG. 8 taken on line 10-10 of FIG. 8.
Figure 11:
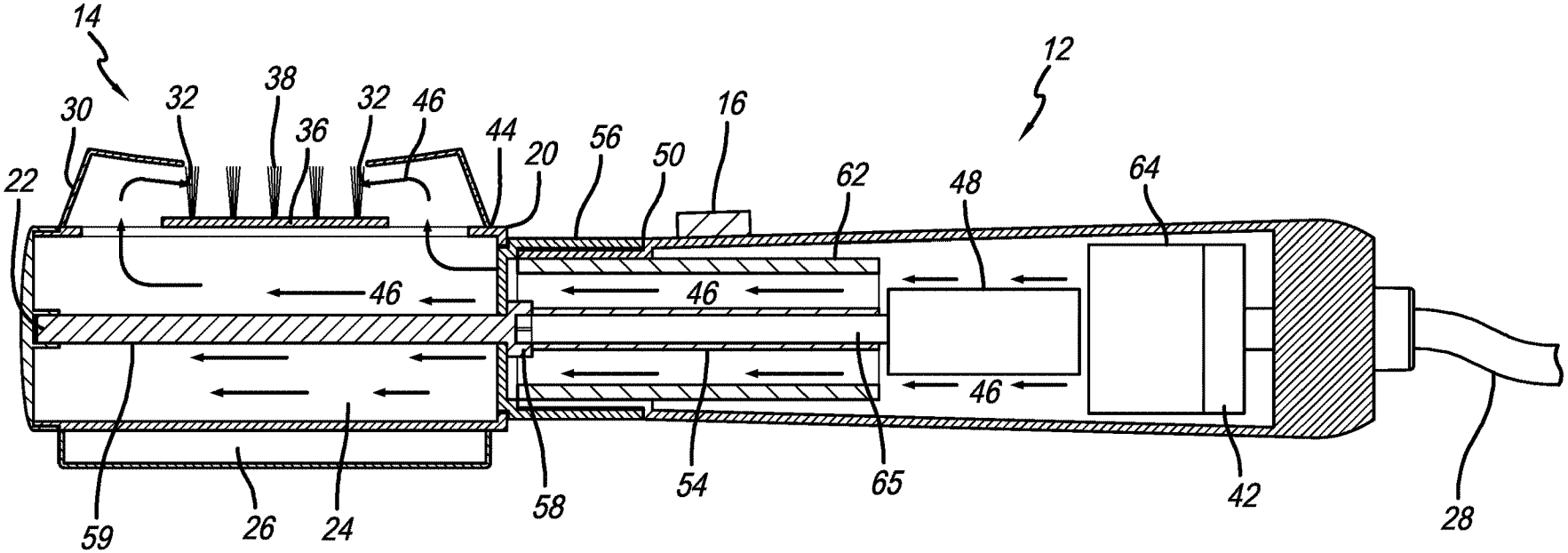
FIG. 11 is a sectional view of the device in FIG. 2 taken on line 11-11 of FIG. 2.

As also shown in FIGS. 1, 3, 4, 6, 7 and 9 the body 14 includes a plurality of projections 38 extending from projection holes 37 in a core 36. Also included on the body 14 are one or more nozzles 32 which provides a path for the flow of air 46 from within the core 36 of the hair styling device 10 to the exterior of the core 36, or otherwise venting out hot air such that the hair is heated with hot air while the hair styling device 10 is in use, as shown in FIGS. 10 and 11 and described further below. According to this exemplary embodiment, the core 36 has within it a hollow internal cavity 24 that allows for heated air flow 46. Also on the body 14 are one or more divider elements 26.

The body 14 also may be referred to as a brush, brush end, or brush portion. In the embodiment shown in FIGS. 1-9, the body 14 comprises a plurality of projections 38 that extend outward from the body 14. The projections 38 can be any type of hairbrush bristle including, for example, boar bristles, nylon or other plastic bristles, or a combination of bristle types, such as boar and plastic bristles. The boar and plastic bristles can be of varying stiffness for different brushing applications, such as soft bristles for thin or fine hair, and stiff bristles for thick or coarse hair. The nylon or plastic bristles can have rounded or balled ends to prevent scratching of the scalp, and boar and plastic or nylon bristles may be combined in one brush for yet other hair brushing applications. Other options may also be used for the projections 38, such as tourmaline, silicon or silicon coated projections 38, or other coatings which reduce frizz and enhance smoothing and detangling of the hair. Preferably, the hair styling device 10 has a plurality of projections 38 which are positioned in one or more rows arranged generally circumferentially around the core 36. The projections 38 can be any height so long as they are high enough to engage the user's hair. The projections 38 extend radially outward from the body 14 from the projection holes 37 and may be attached to the body 14 in a conventional way, depending on the composition of the projections 38.

The hair styling device 10 has at least one divider element 26. FIGS. 1, 2, 4, 5, 7 and 8 show three divider elements 26, but the number of divider elements 26 is a matter of choice. Preferably, the divider element 26 extends substantially the length of the body 14. In all embodiments shown, the divider element 26 is continuous, extending along the entire length of the core 36. Though not shown in the drawings, having spaces between sections of the divider elements 26 may be desirable. These spaces also may be staggered so that adjacent divider elements 26 do not have spaces aligned with each other.

In relation to the projections 38, the divider element 26 can be below or substantially below the height as the projections 38, the same height as the projections 38, or beyond the height of the projections 38, depending on the type, tufting, and number of projections 38 used, such as the type of projections 38 so that the hair will engage with the projections 38. Ideally, the distal surface of the divider element 26 is between 60% and 85% of the height of the projections 38. In one exemplary embodiment for medium-long hair, each projection 38 is about 0.96 inches long. Ideally, the divider element 26 is 0.675 inches in diameter. Therefore, the ratio of the divider element 26 diameter to the radius of the projections 38 is 0.675/0.96-70%. In another exemplary embodiment, such as may be used for longer hair, each bristle is about 1.22 inches long. In this embodiment, the divider element 26 is 1.0 inches in diameter. Therefore, the ratio of the divider element 26 diameter to the projection 38 length is 1.0/1.22=82%.

As shown in FIG. 10, the divider element 26 may be attached to the core 36 as a separate piece; however, while not shown in FIG. 10, the divider element 26 also may be formed as an extension of the core 36. In either case, divider element 26 may be open to internal cavity 24. In such configurations, the divider element 26 would be internally warmed by the heated air following through internal cavity 24 as well as externally warmed by the heated air flowing from the gas flow conduits 30.

Divider element 26 may have a textured surface or may be comprised of an elastomer such as silicone rubber or TPE to enhance smoothing, polishing and detangling of the hair. The divider element 26 may also be comprised of metal, plastic, nylon, wood or other suitable material and have a textured surface and/or an elastomeric coating or inset. The divider element 26 may be comprised of a material that retains heat, such that hot air from the hair styling device 10 or an external blow dryer warms the divider and transfers heat back to the hair even when hot air from the blow dryer is directed elsewhere. In addition, the divider element 26 may be preheated before directing air on the hair.

One function of the divider element 26 is to prevent hair from tangling in the projections 38. Especially when hair is wet, rotation of the hair styling device 10 can carry the ends of the hair around the projections 38 of the hair styling device 10. The hair ends then can get under other parts of the hair and projections 38 and tangle. However, the tangling is prevented by the presence of the divider element 26, which "kick" the hair from the projections 36 to prevent it from tangling in the hair styling device 10. The divider element 26 also warms, smooths and polishes the hair.

The body 14 comprises at least one, and preferably two or more gas flow conduits 30, each having a proximal section 44 attached to or integral to the body 14 and in gas flow communication with a blower 42 and an open distal section 34 having at least one nozzle 32 in gas flow communication with its respective gas flow conduit 30. The gas flow conduits 30 are located towards the ends of the body 14 and are oriented to direct air from the proximal section 44 of the gas flow conduit 30 out of the open distal section 34 of the gas flow conduit 30 towards the body 14, as shown in FIGS. 10 and 11.

Figure 4:
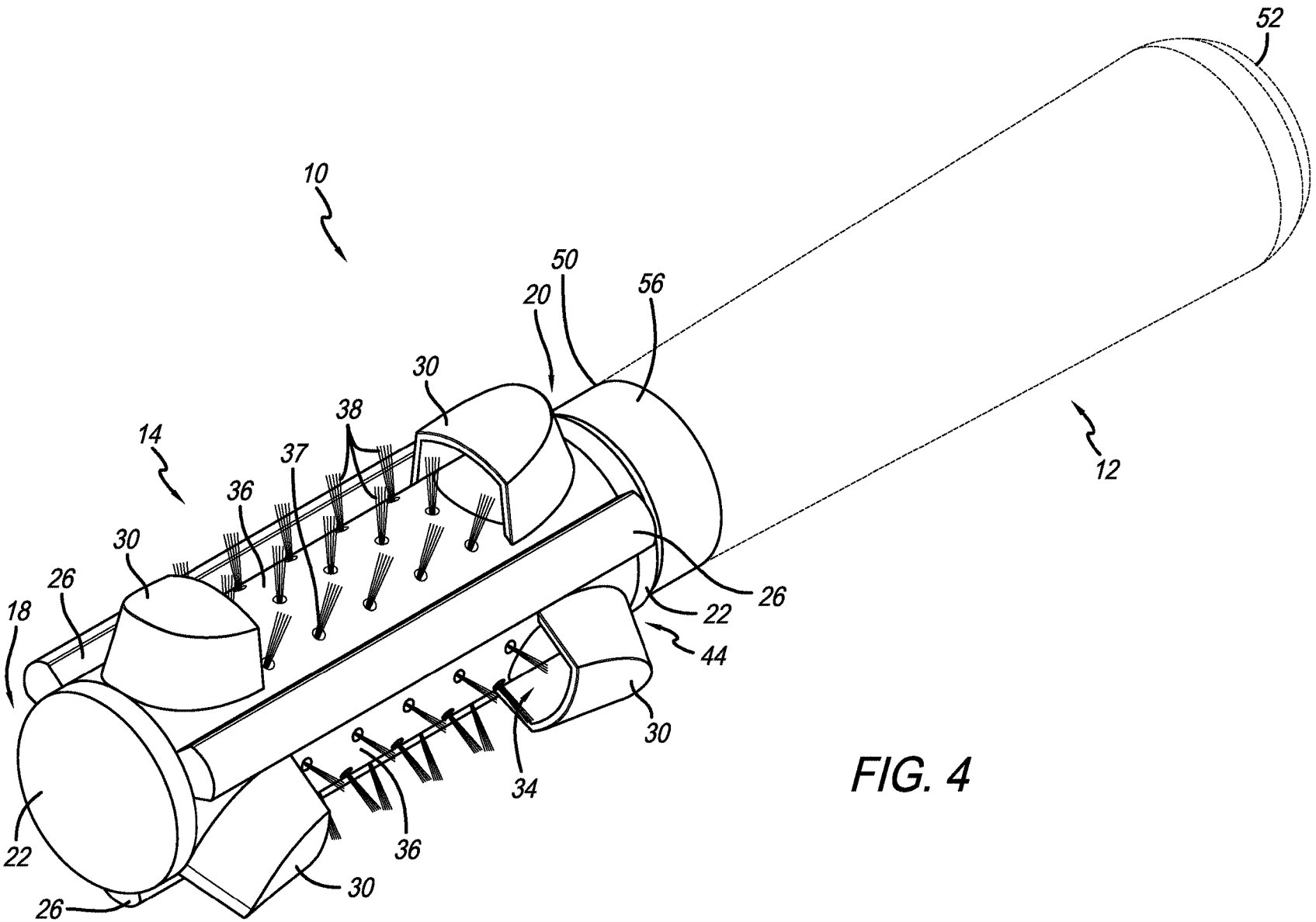
FIG. 4 is a perspective view of a hair styling and drying device having features of the invention.
Figure 5:
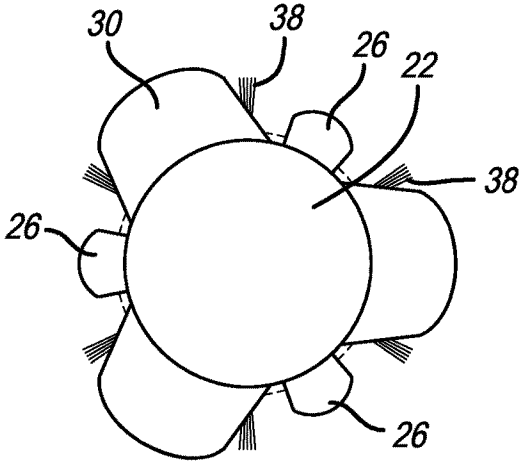
FIG. 5 is a is a top plan view of the hair styling device having features of the invention.
Figure 6:
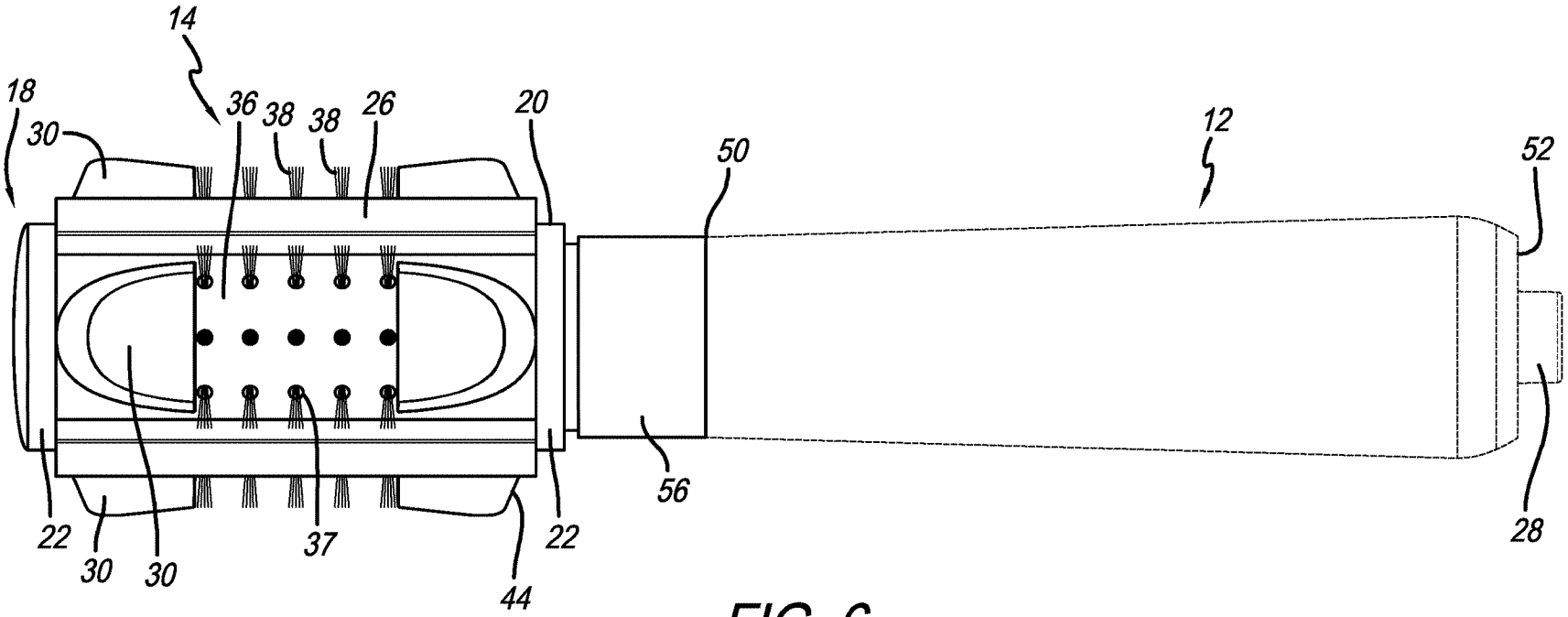
FIG. 6 is a side elevation view of the hair styling device having features of the invention.

The preferred embodiment of the hair styling device 10 contains three sets of two parallel gas flow conduits 30, two sets of which are visible in FIGS. 1, 4 and 7, and three sets of which are visible in FIGS. 2, 3, 5, 6, 8 and 9. The two parallel gas flow conduits 30 work in tandem to direct the air toward the core 36, and in use the air would be directed towards the projections 38 engaged with the user's hair, as shown by the air flow arrows 46 in FIGS. 10 and 11. By having more than one gas flow conduit 30, the air exiting the open distal section 34 of the gas flow conduit 30 is concentrated at the common point. The distance between the two gas flow conduits 30 depends on the size of the body 14, but preferably can be from about 1 to about 6 inches.

Preferably the one or more gas flow conduits 30 are oriented so that the air flow 46 is directed by the gas flow conduit 30 toward the body 36 at an angle less than 45 degrees relative to the longitudinal axis of the body 36, as shown in FIGS. 10 and 11.

FIGS. 10 and 11 depict a cross section of the body 14 comprising internal cavity 24. In this version, a blower 42 is located within the handle 12. As is typical with hair dryers, the handle 12 encases the blower 42 and its components. The blower 42 generally comprises a motor to run a fan located internal to the handle 12 that is electrically connected with a power source such as AC power by a power cord 28. A heater typically is in the handle 12 for heating the air flow travelling therethrough. This version contains a blower 42, which includes a fan assembly 64 and a separate heater assembly 62. In one exemplary version, the heater assembly 62 performs as a resistor to which current is supplied via and power cord 28 or other means. Other examples of a hair styling tool having a heating element may be seen in U.S. Pat. Nos. 7,631,646 and 7,481,228, the entire disclosures of which are hereby incorporated by reference. Other heating means and heating elements, such as a radiant heating element, are within the scope of the present invention, as will be understood by those of skill in the art.

As can be seen in FIGS. 10 and 11, the blower 42 forces air 46 flowing through the internal cavity 24 of the body 12, which is then diverted into the gas conduits 30 which are in gas flow communication with the internal cavity 24. The air then passes through the gas conduits 30 and subsequently through the distal section of the gas conduits 34 towards the projections 38. The arrows in FIGS. 10 and 11 depict the flow of air 42 through the internal cavity 24 and onto the projections 38. According to an exemplary version of the hair styling device 10, the components of the hair styling device 10 are configured to provide a substantially unobstructed flow of air 46 through the body 14 and out the distal end 32 of the one or more nozzles 32, thus concentrating the flow of air 46 towards a common point onto the projections 38.

When the version of the hair styling device 10 having a heating means is used according to the method of the invention, the heating means is started before or after the hair is placed in the projections 38 of the hair styling device 10 and when the hair is brushed, the heating means causes the air 46 coming out of the distal end 32 of the one or more nozzles 32 to be heated.

The rotation assembly of the styling device 10 will now be described with further reference to FIGS. 1, 10 and 11. An electric motor 48 may be housed within the handle 12, the motor 48 being adapted to rotate the body 14. In one exemplary embodiment, the motor 48 powers a motor shaft 65, rotatable within support 54, which extends along a length of the handle 12. The distal end of motor shaft 65 has a drive gear feature which engages a corresponding rotation gear inset feature 58 at the proximal end of rotation rod 59 attached to body 14. The drive gear features are adapted such that when the rotation rod 59 is rotated by the motor shaft 65, the body 14 rotates as well. When the motor shaft 65 interfaces with the rotation rod 59, the rotation rod 59 of body 14 rotates in the same direction and at the same rate as the rotation gear inset 58. In one exemplary embodiment, an electric motor 48 is adapted to power the motor shaft 65 at different rates, depending on a setting adjusted by a user.

In one exemplary embodiment, the electric motor 48 is reversible such that it can rotate the motor shaft 65 in either direction. A rotation direction switch may be electrically connected to the motor 48 to allow the direction of the motor to be set by a user (not shown). The motor 48 may be powered by, for example, electricity from an electrical power cord 28, a rechargeable battery, or by other means sufficient to generate enough energy to power the motor. A switch 16 may be used to activate the motor to drive rotation of the body 14. The switch 16 may be located anywhere on the styling device 10. Although a specific system including gears is described to allow the motor to rotate the body 14, one of ordinary skill in the art will appreciate that many other similar configurations of the driving system will achieve the same result in substantially the same way.

In another embodiment, there is provided a method to style a person's hair using the hair styling device 10. The user can style their hair by (1) selecting the hair styling device 10, (2) turning on the switch 16 to start the blower 42, (3) placing a section of hair so that it contacts a portion of the projections 38 on the hair styling device 10, (4) activating the motor to rotate the body 14 relative to the handle 12 and handle movement collar 56, and (5) styling the hair by pulling the hair styling device 10 toward the tips of the hair. Alternately, the hair styling device 10 is manually rotated. As the body 16 is rotated relative to the handle 12, the projections 38 are pulled through the hair. The divider elements 26 disengage a section of hair from the projections 38 as the body 14 rotates about the handle 12, thus effectively brushing, drying and/or styling the user's hair while reducing or eliminating tangling.

Advantages of the hair styling device 10 described herein include the ability of the device to eliminate tangling while brushing while the hair is being dried or blown out and styled regardless of hair section size, hair length or brush placement. The design of the hair styling device 10 allows the projections 38 to freely engage a section of hair. Then, as the body 14 rotates, the hair encounters a divider element 26 and any hair currently engaged in the projections 38 adjacent to the divider element 26 will be pushed out and away from the projections 38, thus eliminating tangling in the area of the body 14 immediately adjacent to the divider element 26. The distal ends of the divider element 26 further serve to smooth hair while under tension against hair as the body 14 rotates. The pattern of projections 38 and divider elements 26 engaging and disengaging the hair as the body rotates, ensures that the hair is effectively brushed without tangling. In addition, the styling device 10 can be used effectively at a variety of angles so that a user can brush and dry his/her own hair, even at odd angles, such as the back of their own hair. Accordingly, the styling device 10 can be used to apply proper tension on the hair, and when heat is applied during the blow out, even frizzy and otherwise unmanageable hair can achieve a sleek, glossy appearance which can last for several days. Further, with the styling device 10 according to the invention, an entire head of hair can be blown out and styled more efficiently and in a much shorter period of time due to the combination of the concentration of the hot air onto the hair bristles as well as the higher speed of the motorized rotation of the brush then could otherwise be done with manual rotation. This gives professional looking results on one's own head of hair, thus lessening trips to the salon for a professional blow dry, which can be a significant time and cost savings to the user.

In certain versions of the invention, the hair may be heated and styled without the use of a hair dryer, which is highly convenient for the user. In other versions of the invention having a heated blower, the hair may be simultaneously dried and styled. This is a significant time savings for the user which allows the hair to dry more quickly, but also provides the hair with smoothing volume and a healthy shine.

Whether the features of the present invention are configured as an attachment with a hair dryer or integral with a blower 42, the user needs only to hold the hair styling device 10 or hair dryer with one hand, while selecting portion of the hair to be treated with the same or opposite hand. When the section of hair is engaged the hair is pulled away from the user while the body 14 is simultaneously blowing hot air out of the gas flow conduits 30 and rotating.

Although the present invention has been discussed in considerable detail with reference to certain preferred versions of the invention, other versions of the invention are possible. For example, the size and shape of the divider element 26 may be varied, as well as the type and length of the projections 38, the means of rotation, the shape of the body 14, and/or the heating means. Therefore, the scope of the appended claims should not be limited to the description of preferred versions of the invention contained herein.

What is claimed is:

1. A hair styling device comprising:

(a) a handle;

(b) a blower supported by the handle;

(c) a body having a longitudinal axis and attached to the handle;

(d) a plurality of projections extending outwardly from the body;

(e) two or more divider elements extending from the body;

(f) a first gas flow conduit in gas flow communication with the blower, the first gas flow conduit having a longitudinal axis and a proximal portion supported by the body and a distal portion away from the body;

(g) a first nozzle in gas flow communication with the distal portion of the first gas flow conduit and oriented to blow air from the distal portion of the first gas flow conduit toward the body at an angle greater than one hundred degrees relative to the longitudinal axis;

(h) a second gas flow conduit in gas flow communication with the blower, the second gas flow conduit having a longitudinal axis and a proximal portion supported by the brush portion and a distal portion away from the body;

(i) a second nozzle in gas flow communication with the distal portion of the second gas flow conduit and oriented to blow air from the distal portion of the second gas flow conduit toward the body at an angle greater than one hundred degrees relative to the longitudinal axis; and (j) a motor for rotating the body about its longitudinal axis relative to the handle.

2. The hair styling device of claim 1, wherein the motor can rotate the body portion both in clockwise and counterclockwise directions.

3. The hair styling device according to claim 1 wherein the projections are bristles.

4. The hair styling device according to claim 1 wherein at least a portion of the plurality of projections are positioned in a row extending parallel to a longitudinal length of the body and between the two or more divider elements.

5. The hair styling device according to claim 1 further comprising a heating means.

6. The hair styling device according to claim 5 wherein the heating means is a heating element.

7. The hair styling device according to claim 5 wherein the heating means is a heated blower.

8. The hair styling device of claim 1, wherein the gas flow conduit has a longitudinal axis and the nozzle directs the air from the distal portion of the gas flow conduit toward the body at an angle greater than one hundred degrees relative to the longitudinal axis.

9. A hair styling device comprising:

(a) a rotatable body portion, the body portion comprising a longitudinal axis about which the body rotates;

(b) a plurality of projections extending outwardly from the body portion;

(c) two or more divider elements extending from the body portion;

(d) a handle attached to the body portion;

(e) a blower supported by the handle;

(f) a first gas flow conduit in gas flow communication with the blower, the first conduit having a proximal portion supported by the body portion and a distal portion away from the body portion; and (g) a first nozzle in gas flow communication with the first conduit and oriented to blow air from the distal portion of the first conduit toward the body portion.

10. The hair styling device of claim 9, wherein the motor can rotate the body portion both in clockwise and counter-clockwise directions.

11. The hair styling device according to claim 9 wherein the projections are bristles.

12. The hair styling device according to claim 9 wherein at least a portion of the plurality of projections are positioned in a row extending parallel to a longitudinal length of the body and between the two or more divider elements.

13. The hair styling device according to claim 9 further comprising a heating means.

14. The hair styling device according to claim 5 wherein the heating means is a heating element.

15. The hair styling device according to claim 5 wherein the heating means is a heated blower.

16. The hair styling device of claim 1, wherein the gas flow conduit has a longitudinal axis and the nozzle directs the air from the distal portion of the gas flow conduit toward the body at an angle greater than one hundred degrees relative to the longitudinal axis.

17. A method of styling a section of hair comprising the steps of:

a) grasping a hair styling device, the hair styling device comprising:

(i) a rotatable body portion, the body portion comprising a longitudinal axis about which the body rotates;

(ii) a plurality of projections extending outwardly from the body portion;

(iii) two or more divider elements extending from the body portion;

(iv) a handle attached to the body portion;

(v) a blower supported by the handle;

(vi) a first gas flow conduit in gas flow communication with the blower, the first conduit having a proximal portion supported by the body portion and a distal portion away from the body portion; and (vii) a first nozzle in gas flow communication with the first conduit and oriented to blow air from the distal portion of the first conduit toward the body portion;

b) placing the section of hair adjacent to and engaged with the plurality of projections in a location where the air is blown from the first and second nozzles;

c) before or after step (b), activating the rotatable body portion;

d) before or after step (b), activating the blower; and e) pulling the hair styling device through the hair while the air is blown from the first and second nozzles and the body rotating about the longitudinal axis.

* * * * *